US005117897A

United States Patent [19]

Robert

[11] Patent Number: 5,117,897

[45] Date of Patent: Jun. 2, 1992

[54] VEHICLE FOR INSPECTING AND MAINTAINING STEAM GENERATOR TUBES OR THE LIKE

[75] Inventor: Nicolas M. B. Robert, Volx, France

[73] Assignee: Barras-Provence, Manosque, France

[21] Appl. No.: 463,592

[22] Filed: Jan. 11, 1990

[30] Foreign Application Priority Data

Feb. 15, 1989 [FR] France ..... 89/02152

[51] Int. Cl.[5] ..... B25J 9/04; B25J 9/06

[52] U.S. Cl. ..... 165/11.2; 165/76; 376/245; 376/260; 414/744.5; 414/744.6; 414/749; 414/750; 901/1; 901/15; 901/44

[58] Field of Search ..... 165/11.1, 76; 376/260, 376/245; 414/744.5, 744.6, 750, 749; 901/1, 15, 44

[56] References Cited

U.S. PATENT DOCUMENTS

| | | | |
|---|---|---|---|
| 3,913,752 | 10/1975 | Ward et al. | 165/76 |
| 3,984,008 | 10/1976 | Syun-ichi et al. | 165/76 |
| 4,004,698 | 1/1977 | Gebelin | 165/76 |
| 4,193,735 | 3/1980 | Savor et al. | 165/76 |
| 4,303,368 | 12/1981 | Denb et al. | 165/76 |
| 4,373,855 | 2/1983 | Lebouc | 165/76 |
| 4,521,150 | 6/1985 | Pigeon et al. | 165/76 |

FOREIGN PATENT DOCUMENTS

| | | |
|---|---|---|
| 63073 | 10/1982 | European Pat. Off. . |
| 2755733 | 12/1977 | Fed. Rep. of Germany . |

*Primary Examiner*—John Ford
*Attorney, Agent, or Firm*—Dvorak and Traub

[57] ABSTRACT

A vehicle of the invention comprises at least two transfer arms including means for causing expansible positioning fingers to penetrate into the tubes of a steam generator and for extracting said fingers from said tubes. The vehicle also includes at least two pivoting fastening heads which contain said expansible positioning fingers. The heads are interconnected by one of the telescopic transfer arms, which arms extend perpendicularly to said pivoting heads. The other telescopic transfer arm is fixed to one of the heads and it extends perpendicularly therefrom with its opposite end carrying a tool support. Such a vehicle is particularly suitable for inspecting and maintaining tubes in tube apparatuses, e.g. the steam generators of pressurized water nuclear reactors.

13 Claims, 14 Drawing Sheets

FIG. 5
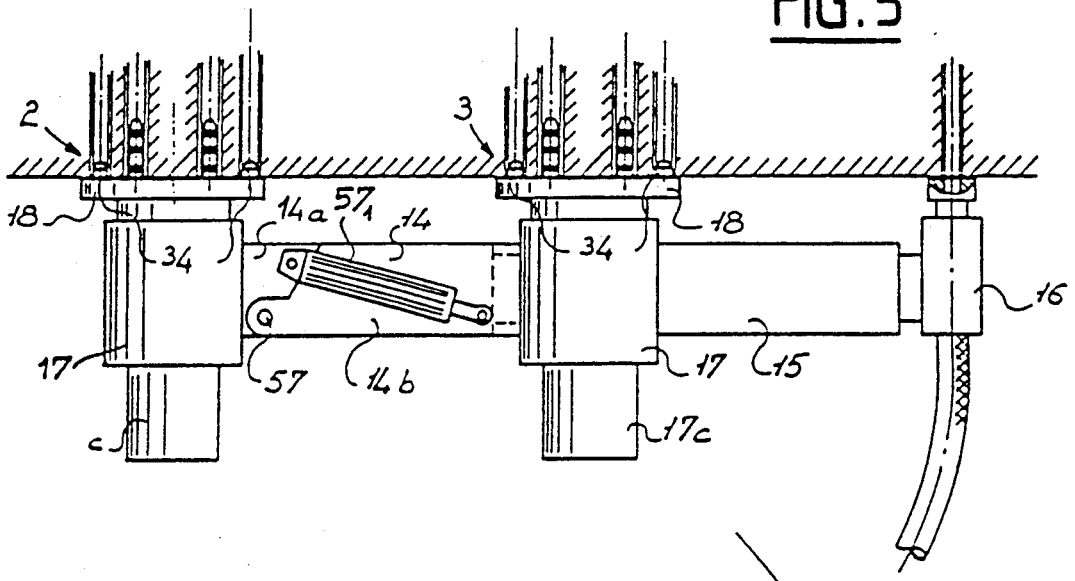
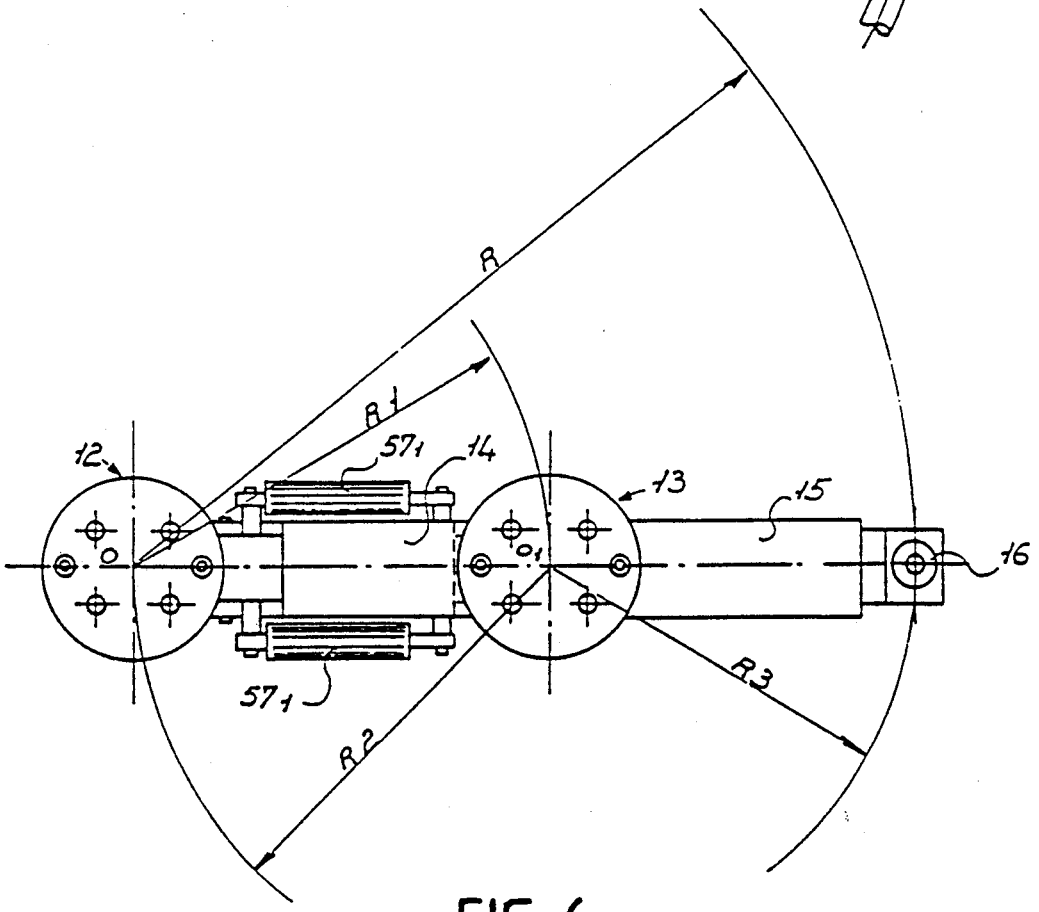
FIG. 6

FIG. 7
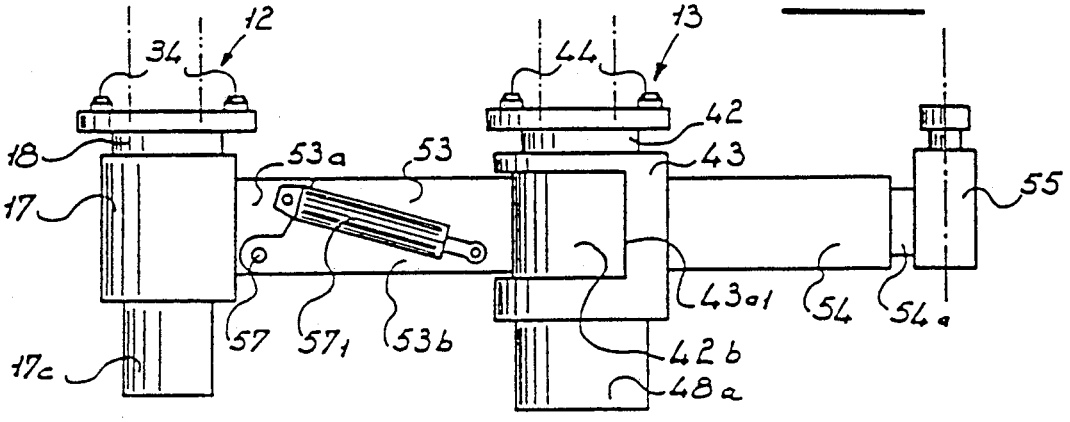
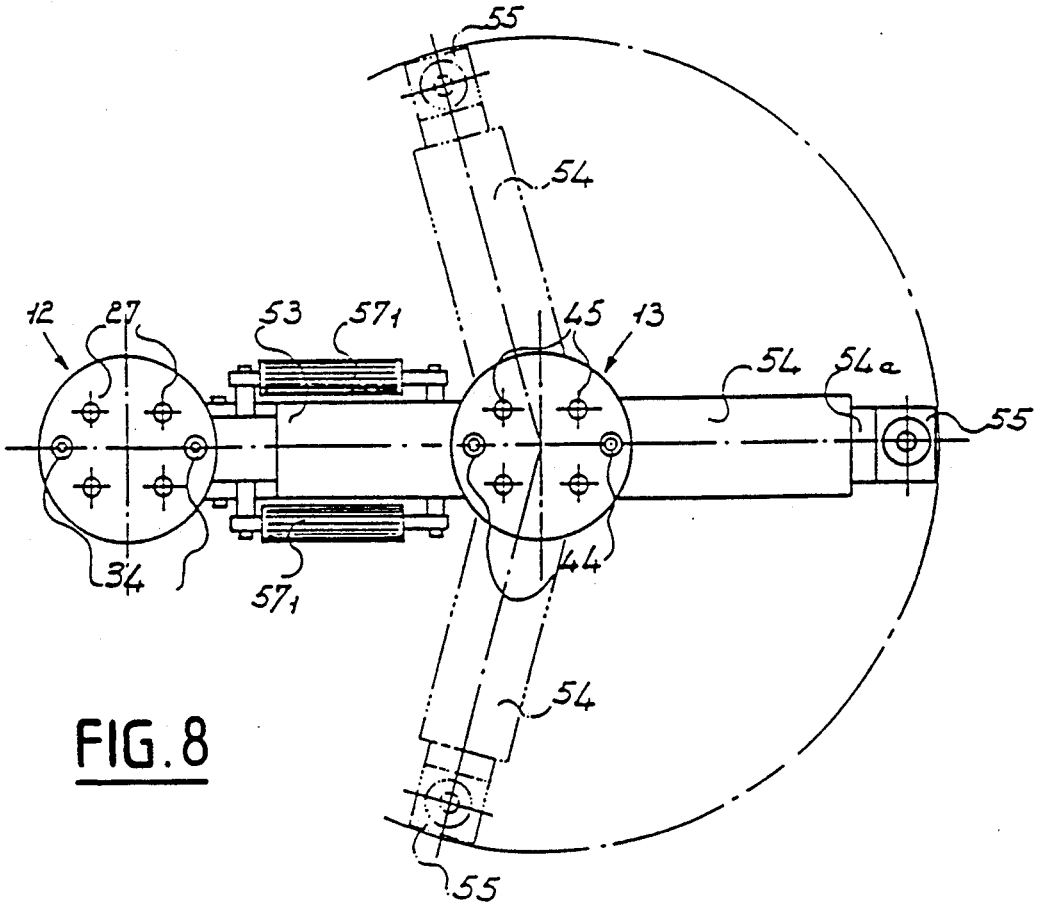
FIG. 8

FIG. 9
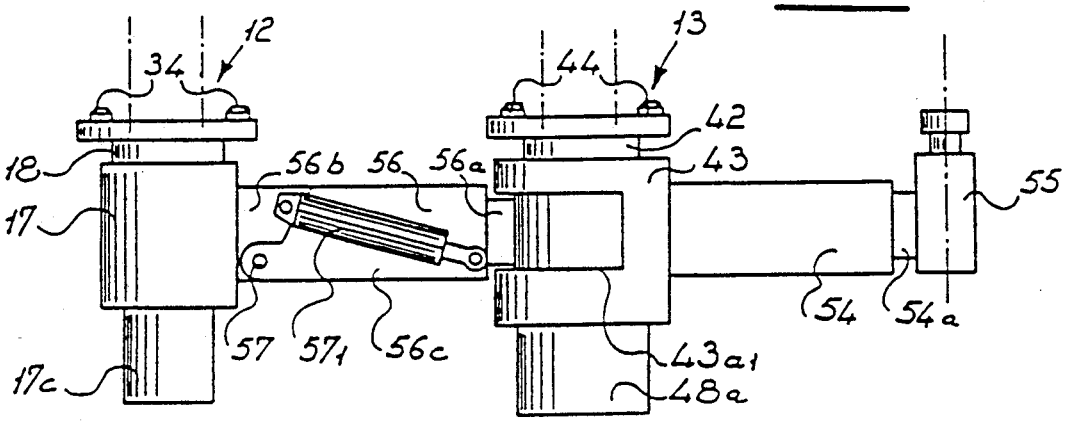
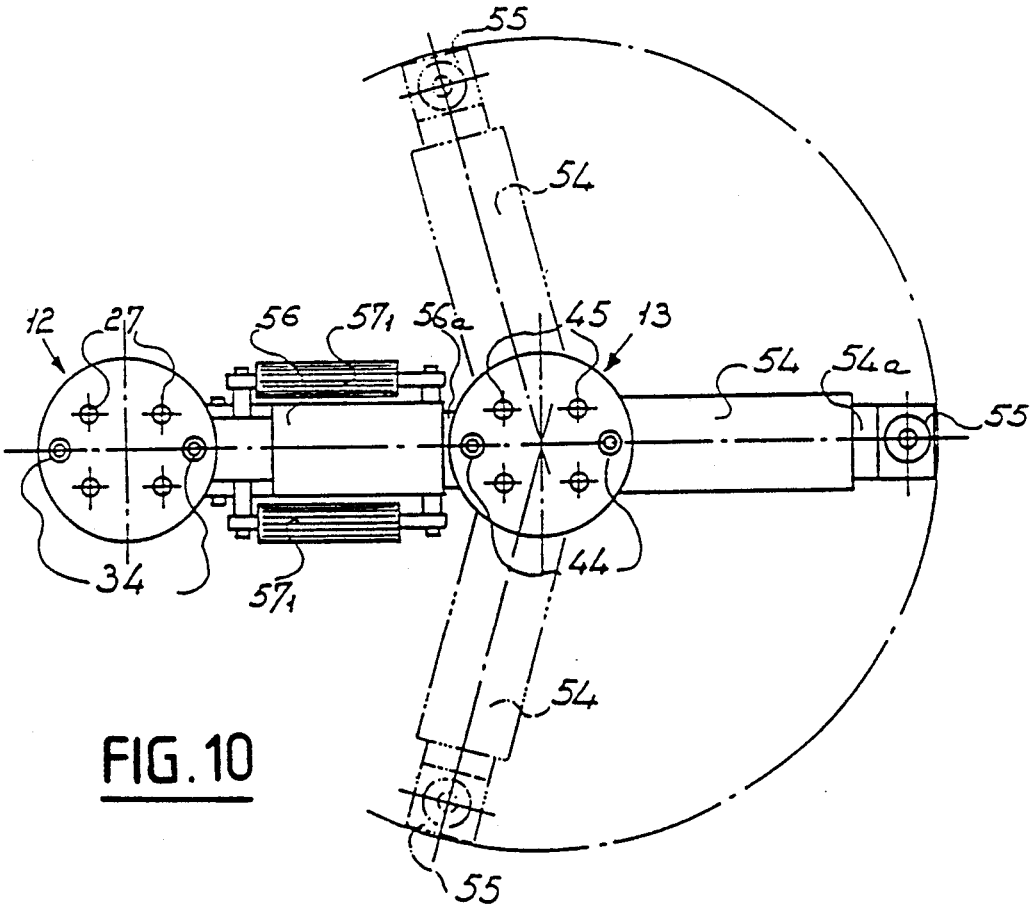
FIG. 10

FIG. 15
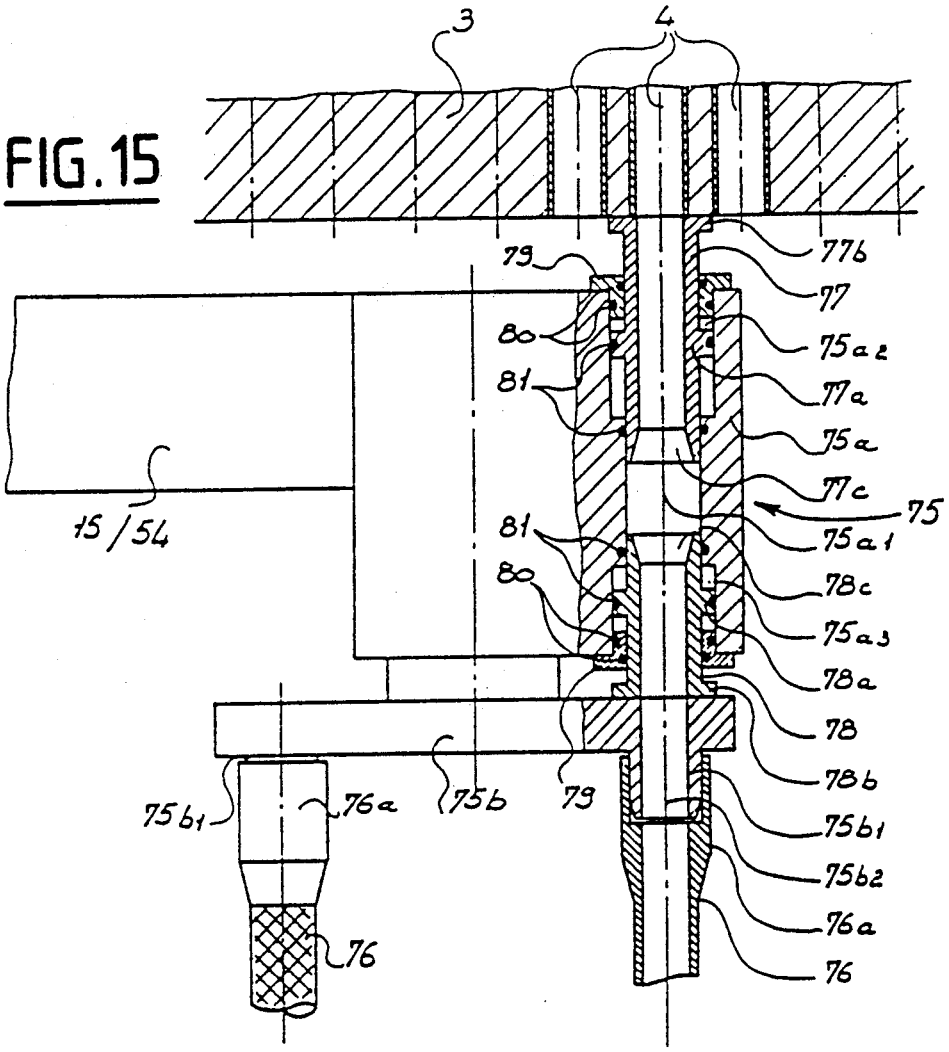
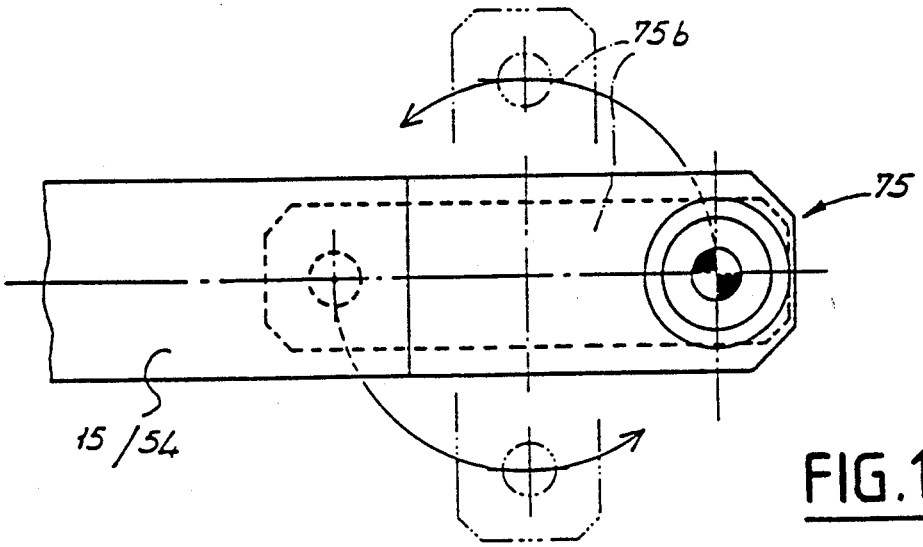
FIG. 16

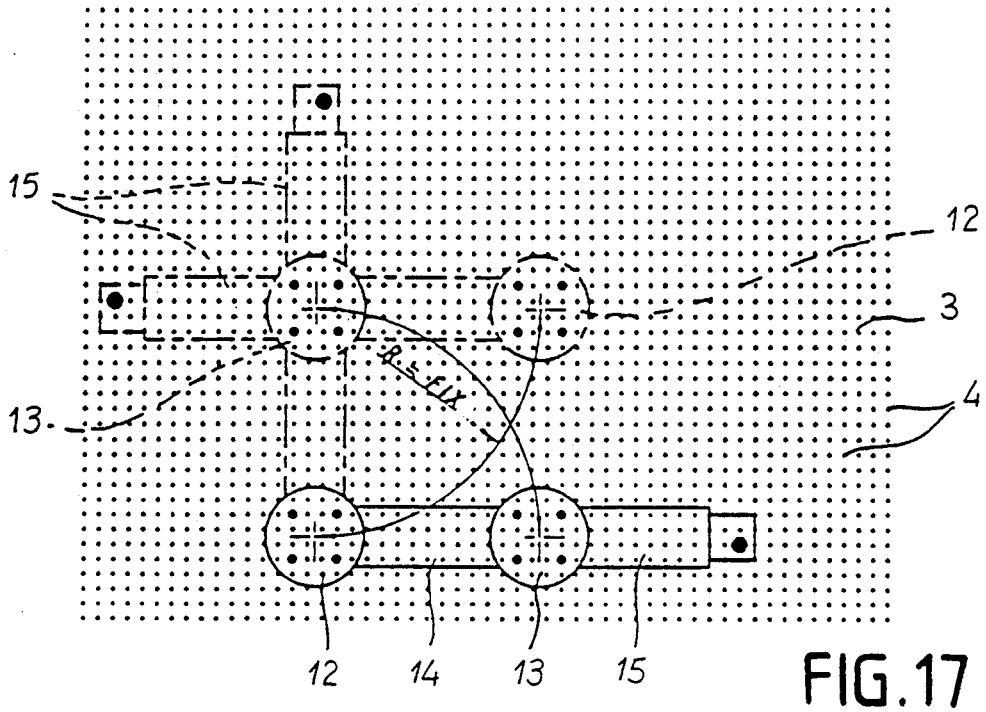
FIG.17
FIG.18
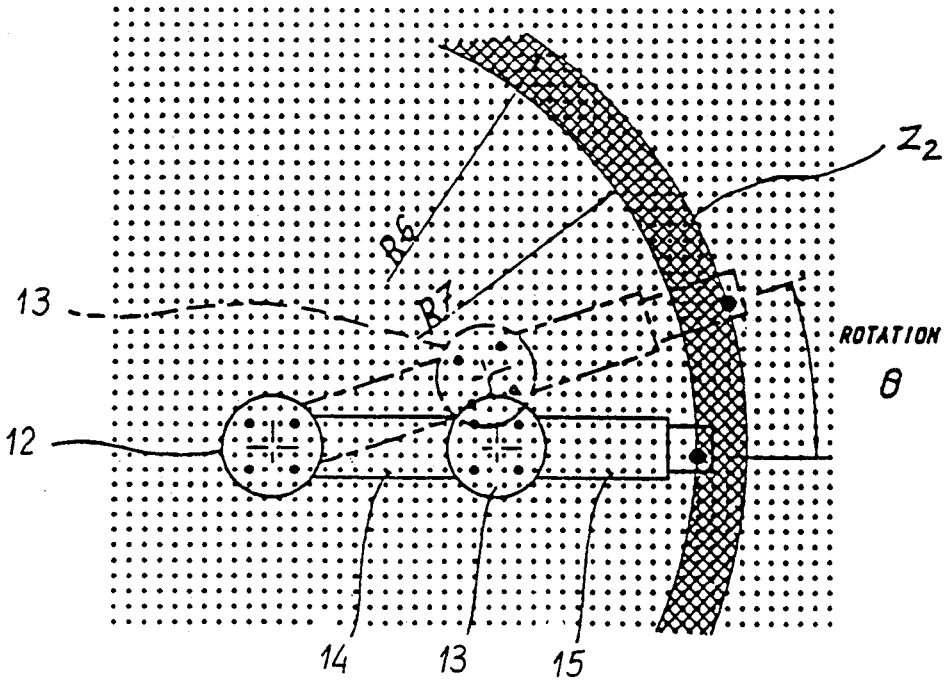

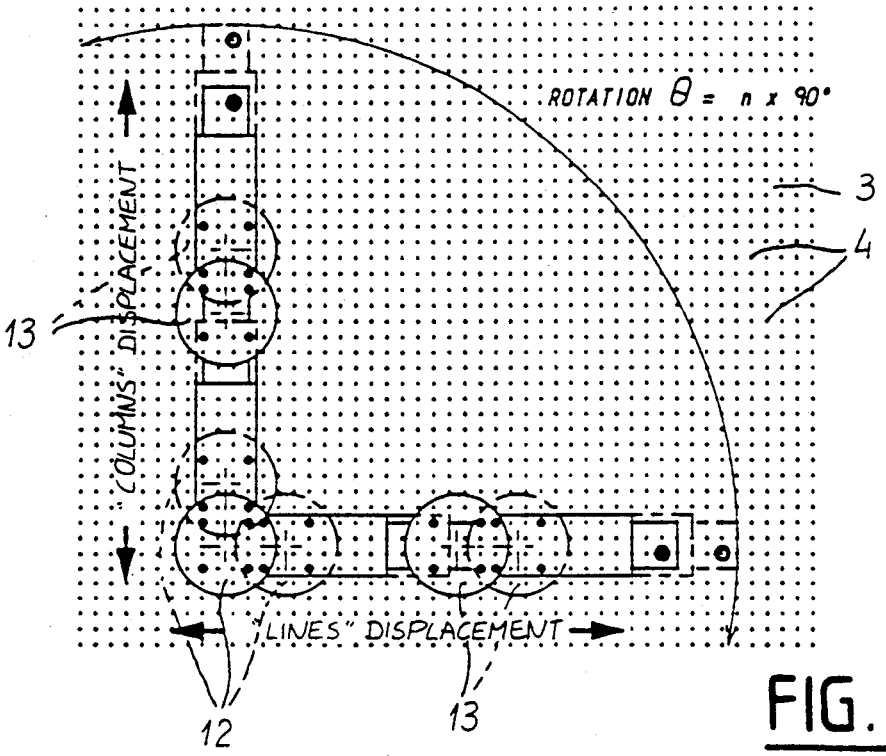
FIG. 21
FIG. 22
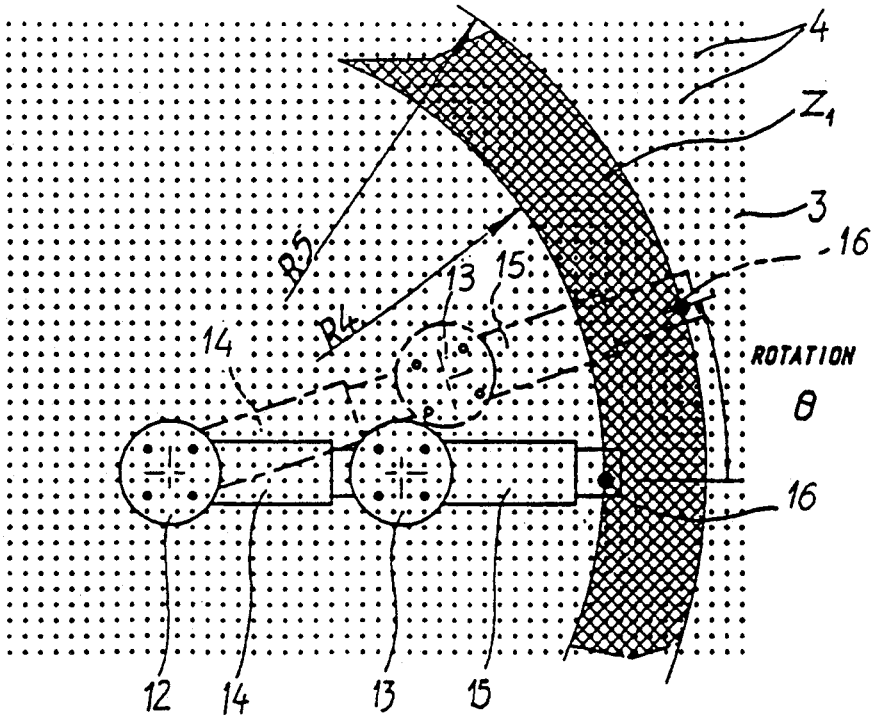

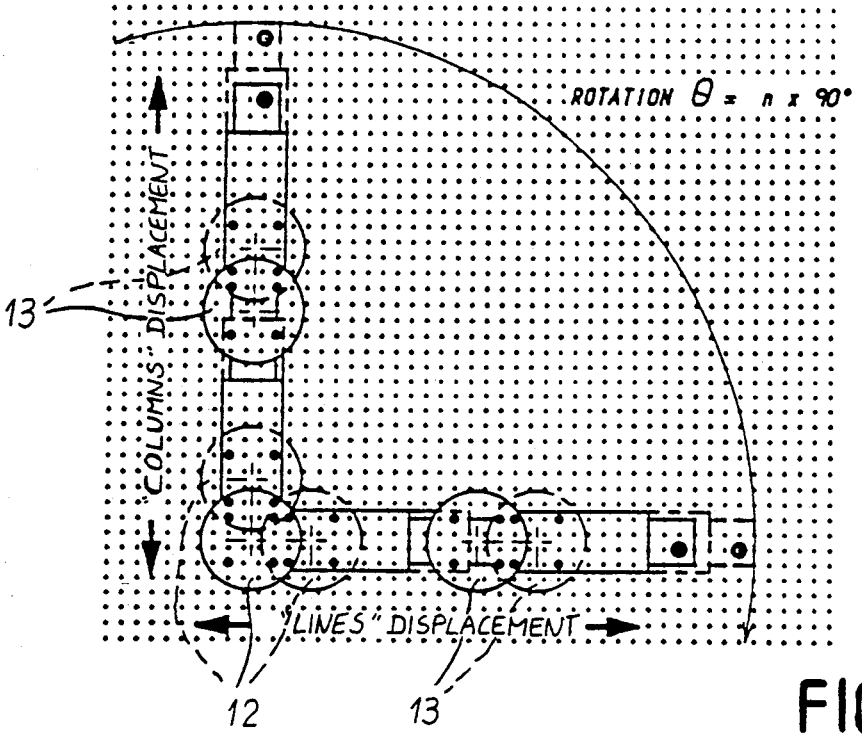
FIG. 23
FIG. 24
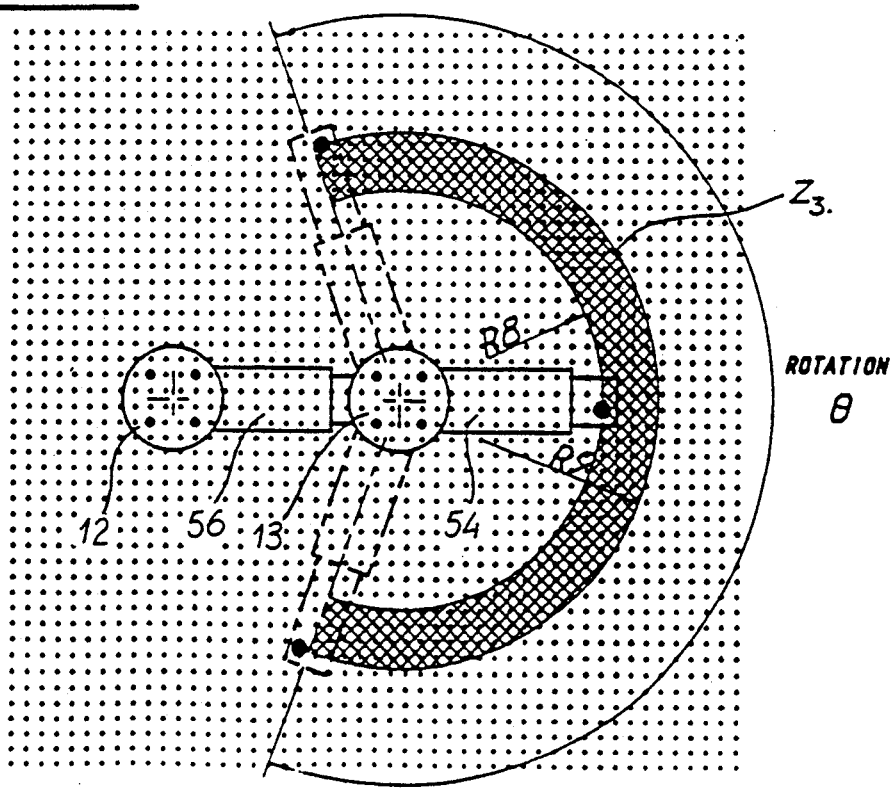

VEHICLE FOR INSPECTING AND MAINTAINING STEAM GENERATOR TUBES OR THE LIKE

DESCRIPTION

The present invention relates to a vehicle for inspecting and maintaining steam generator tubes or the like.

The technical field of the invention is devices for inspecting and/or maintaining, repairing, or taking out of service tubes in tube apparatuses, e.g. steam generators for pressurized water nuclear reactors.

BACKGROUND OF THE INVENTION

Vehicles already exist that are designed to move beneath the tube plate of such apparatuses in order to engage the ends of the tube and insert inspection tools into the tubes, e.g. eddy current probes, or else tools for performing actions in the tubes such as cleaning, plugging, or other actions.

Prior vehicles are designed to move stepwise in X and Y directions or in rotation in order to engage the tubes fitted in said tube plate.

Such vehicles are specially adapted to move stepwise over specifically determined types of mesh.

After working in this field, the Applicant has already implemented a vehicle for stepwise displacement to position a tool selectively to engage any one of the tubes in a bundle of tubes received in a tube plate, regardless of the geometry or the layout of the tubes over said plate.

The object of the present invention is to provide a vehicle for inspecting and maintaining tubes in a tube bundle apparatus and capable, under remote control, of moving quickly underneath the tube plate of said apparatus in a non-stepwise manner, regardless of the geometry of the layout of the tubes in the plate, such a vehicle being adapted to bring several different types of tool successively into engagement with the tubes.

SUMMARY OF THE INVENTION

This object is achieved by a vehicle for selectively positioning a tool relative to tubes in a bundle of tubes received in a tube plate and opening out into an enclosure including an access opening, the vehicle comprising at least two transfer arms including means for causing expansible positioning fingers to penetrate into said tubes and for extracting said fingers from said tubes perpendicularly to said tube plate in order to displace the vehicle adjacent the face of the tube plate situated in said enclosure, with at least one of said arms including a tool support for presenting a tool successively on the axis of a plurality of tubes in the plate, which vehicle includes at least two pivoting fastening heads each comprising a body with a cylindrical bore in which a hollow telescopic shaft is coaxially mounted, said shaft comprising two elements, one of which is moveable in translation under drive from drive means, and the other of which is mounted to rotate in said body, said expansible positioning fingers being mounted in said moving element in such a manner as to be capable of extending beyond the end of said shaft or of retracting into said shaft, said fingers being parallel to each other and to said pivoting heads, which heads are interconnected to each other by one of said transfer arms, which arm extends perpendicularly to said pivoting heads, the other arm being telescopic, being fixed to one of said heads, and extending perpendicularly therefrom, and the tool support being fixed to said arm.

The two elements of the telescopic shaft are interconnected to each other by a sliding key in order to be constrained to rotate together.

In one embodiment, each pivoting fastening head includes at least two positioning fingers.

In another embodiment, each fastening head includes four positioning fingers disposed in a square and diametrically opposite to each other in pairs along two perpendicular axes.

The moving element of the telescopic shaft has a plane annular zone extending perpendicularly to the axis of revolution of the shaft and located at the end of the said moving element which is situated outside the said other element of the telescopic shaft, said plane annular zone having at least two centering studs extending therefrom and situated outside said positioning fingers, said studs being slightly smaller in diameter than the holes through the tube plate and having conical tips in order to facilitate insertion thereof into said holes.

In an embodiment, said arms are fixed to the bodies of said pivoting heads, and each head includes means for causing the body and the telescopic shaft to pivot relative to each other, together with means for sensing their relative angular displacement.

The portion of the shaft which is rotatably mounted in the body of each pivoting head has a toothed ring at its end situated facing the end wall of the body, with the relative pivoting of the body and the telescopic shaft being obtained by means of a motor fixed to said body and having a gear wheel fixed to its drive shaft and meshing with the said toothed ring, and with the relative angular displacement of the body and the shaft being sensed by an absolute encoder fixed to said body and including a gear wheel meshing with said toothed ring.

The body of one of the pivoting heads includes, in its side wall, an elongate opening extending perpendicularly to the generator lines of the body in order to enable one of the transfer arms to move angularly, which arm is fixed at its end, firstly to the element of the telescopic shaft which is mounted to rotate in said body, and secondly to the body of the other pivoting head, with the other arm to which the tool support is fixed being itself fixed to the body of the said one of the pivoting heads.

In an embodiment, the telescopic shaft has a coaxially mounted collar at its end opposite to its moving element, said collar being fixed to a support extending perpendicularly to said collar and said support having a motor fixed thereon, with the shaft of said motor having a gear wheel fixed thereon and meshing with a toothed ring situated at the open bottom end of the body of the pivoting head which includes said opening, thereby causing said body to pivot relative to said telescopic shaft, said support also having an absolute encoder fixed thereon including a gear wheel which meshes with said ring in order to sense the relative angular displacement of said body and said telescopic shaft.

In an embodiment, the transfer arm interconnecting the two pivoting heads is telescopic in order to modify the distance between said heads.

Each telescopic arm comprises a moving element guided in a fixed element, with said moving element being moved in translation by a motor mounted in the fixed element of the arm and rotating a backlash-free ball screw which co-operates with a nut fixed at the end of the moving element situated inside the said fixed element, said motor being coupled to an absolute encoder which, at all times, specifies the relative position between the fixed element and the moving element of said arm.

The said vehicle includes at least one intermediate fastening head situated between an end fastening head and said tool support, with the arm interconnecting said pivoting heads being articulated about an axis perpendicular to the axes of said heads and situated adjacent to said end head.

The vehicle includes means for causing the arm to pivot and for locking it in position, either in a working position where it extends perpendicularly to the heads, or else in a position for insertion into the enclosure and for fastening to the tube plate, in which position said arm extends parallel to the end pivoting head.

In an embodiment, the tool support has at least two positions for presenting at least two tools in succession to the same tube in the tube plate, the tool carrier being disposed parallel to said telescopic arm in a position perpendicular to the pivoting heads so as to present each tool in turn to a transfer duct provided through the end of the moving element of said arm, which duct includes means for guiding the tool and for transferring it from the support to said tube in the tube plate.

Each end of said transfer ducts includes a respective coaxial chamber communicating with the other chamber, with each of said chambers receiving a tool-guiding sleeve mounted as a piston, said sleeves operating simultaneously in the tool transfer position firstly to provide a connection between the arm and the tube plate, with one of the sleeves engaging one of the tubes coaxially, and secondly to provide a connection between the arm and said support, with the other sleeve coaxially engaging the orifice of said tool support.

The result of the invention is to provide a remotely controlled vehicle capable of moving quickly, independently of the tube pitch, beneath the tube plate of an apparatus having a bundle of tubes, for the purpose of inspecting and maintaining the tubes of the apparatus.

An advantage of the vehicle of the invention is the speed with which it can move relative to the tube plate of the apparatus regardless of the geometrical layout of the tubes in the plate.

BRIEF DESCRIPTION OF THE DRAWINGS

Embodiments of the invention are described by way of example with reference to the accompanying drawings, in which:

FIG. 5 is a diagrammatic elevation view of a vehicle showing two embodiments, one having a single telescopic arm for tool carrying, and the other having two telescopic arms;

FIG. 6 is a plan view of the FIG. 5 vehicle;

FIG. 7 is a diagrammatic elevation view of another embodiment having a single tool-carrying telescopic arm and a hinge at the intermediate fastening head;

FIG. 8 is a plan view of the FIG. 7 vehicle;

FIG. 9 is a diagrammatic elevation view of another embodiment of the vehicle having two telescopic arms and a hinge at the intermediate fastening head;

FIG. 10 is a plan view of the FIG. 9 vehicle;

FIG. 15 is a fragmentary section view through a tool support in an embodiment where the support is a pivoting support having means for guiding the tool relative to the support towards the tube plate;

FIG. 16 is a plan view of FIG. 15; and

FIGS. 17 to 24 show various stages in the operation of various embodiments of the vehicle beneath the tube plate of an apparatus having a bundle of tubes, e.g. a steam generator for a pressurized water nuclear reactor.

DETAILED DESCRIPTION

Figure 1:
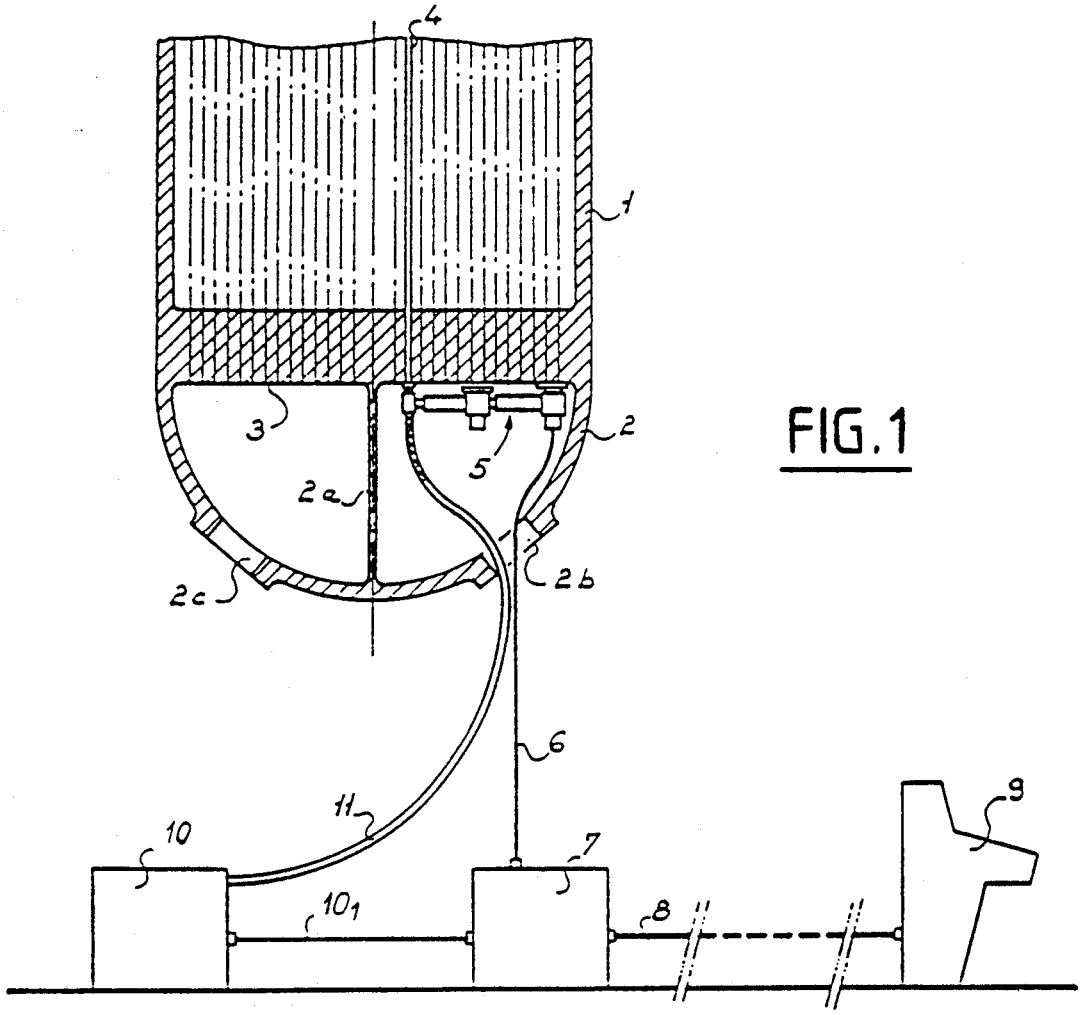
FIG. 1 is a diagrammatic fragmentary section through the bottom portion of a steam generator and showing a vehicle of the invention engaged beneath the tube plate of the generator.

Reference is made initially to FIG. 1 of the accompanying drawings which shows the bottom end of a tube bundle apparatus such as a steam generator 1 having a hemispherical water tank 2 split into two equal portions by a diametral partition 2*a* with access being provided to each of these two portions via circular accesses or "manholes" 2*b* and 2*c*. The top of the water tank 2 is delimited by a perforated tube plate 3 which receives the ends of tubes 4 extending perpendicularly to the plate 3 and parallel to the axis of the generator 1.

The vehicle of the invention is referenced 5 and is shown in operation beneath the tube plate 3, with the vehicle being connected via an umbilical cord 6 to a servo-control box 7 located in the environment of the generator and in turn connected via another umbilical cord 8 to a control desk 9 installed in premises at a distance from the generator. Another box 10 also situated in the environment of the generator operates the tooling, with tools being conveyed to the vehicle 5 via a hose 11. The box 10 is connected to the box 7 by an umbilical cord 101. The tooling is controlled from the control desk 9.

The umbilical cord 6 and the hose 11 are passed through said opening 2*b*.

One embodiment of a vehicle in accordance with the invention is shown in FIGS. 5 and 6; this embodiment comprising two pivoting fastening heads 12 and 13 which are interconnected by an arm 14, together with another arm 15 having a tool support 16 disposed at the end thereof. The heads 12 and 13 are parallel to each other and their ends are situated in pairs in the same planes. The arms 14 and 15 are perpendicular to said heads and are disposed in line with each other.

In one particular embodiment of the heads 12 and 13 (FIG. 11), each head comprises a cylindrical body 17 having a side wall 17*a* and an end wall 17*b*. A hollow telescopic shaft 18 is rotatably mounted in the cylindrical bore of the body 17 and has a moving element $\mathbf{18}_1$ capable of moving in translation parallel to the axis of the shaft 18 inside an element $\mathbf{18}_2$. This element is cylindrical and has a side wall $\mathbf{18}_{2a}$ and an end wall $\mathbf{18}_{2b}$ including a cylindrical tubular extension of smaller cross-section $18_{2c}$. The moving element $18_1$, the element $18_2$, and the extension $18_{2c}$ are coaxial.

The element $18_2$ has a cylindrical bore delimited by the wall $18_{2a}$ and the end wall $18_{2b}$, and in which said moving element $18_1$ is a sliding fit. The elements $18_1$ and $18_2$ are constrained to rotate together by means of a sliding key system comprising a rectangular key 19, having rounded ends, for example, and received in the moving element $18_1$ to cooperate with a groove $18_{2d}$ formed in the wall $18_{2a}$ of the element $18_2$, with the key and the groove running parallel to generator lines of said shaft $18_1$, $18_2$.

The cylindrical tubular extension $18_{2c}$ of the element $18_2$ is received in a sleeve $17_c$ coaxial with the body 17 and fixed to its end wall $17_b$, with the element $18_2$ being received by means of two ball bearings or the like 20 and 21. The end of the extension $18_{2c}$ is threaded to receive a nut 22 which is tightened against the moving ring of the bore bearing 21.

At its end opposite to said extension, the element $18_2$ is mounted to rotate inside the cylindrical body 17 on another ball bearing or the like 23.

The moving element $18_1$ of the shaft 18 is hollow and comprises a side wall $18_{1a}$ and an end wall $18_{1b}$ fixed to a thick annular wall $18_{1c}$ in which a plurality, e.g. four, cylindrical bores $18_{1d}$ are formed at 90° intervals and extending parallel to the axis of revolution of the shaft 18. The bores are closed at their ends by plugs 24 and 25 in order to form double-acting actuator chambers, e.g. pneumatically operated, each having a rod 26 whose free end is fitted with an expansible positioning and fastening finger 27. In conventional manner, the rod 26 is fixed to a piston 28 which is a sliding fit inside the chamber $18_{1d}$. Sealing is provided at the plugs 24 and 25 relative to the rod 26 and to the bore $18_{1d}$ by means of O-rings 29. Sealing round the piston 28 in the chamber $18_{1d}$ is provided by means of an O-ring 30.

The rod 26 extends away from the fingers 27 in order to slide through the plug 25 and its bottom end carries an actuator 31 whose rod 32 and piston 33 are used to cause the fingers 27 to expand in order to fasten them inside the tubes 4 of the tube plate 3, or enable them to be retracted and extracted from said tubes.

Mounted in this way, the fingers 27 are two-position fingers: when extended outside the shaft 18, as shown in solid lines, they are inserted in the tubes 4 of the generator; and when retracted into the shaft, as shown in dashed lines, they allow the fastening head to move parallel to the tube plate 3.

The end of the moving element $18_1$ situated outside the element $18_2$ has a flange $18_{1e}$ including a plane annular zone extending perpendicularly to the axis of revolution of the shaft and from which two diametrically opposite centering studs 34 project, which studs are suitable for penetrating with minimum clearance into the tube 4 of the bundle. The ends 34*a* of these studs are conical in order to facilitate insertion into the tubes, and they include annular abutments 34*b* which come into contact with the tube plate 3. The fingers 27 are spaced apart relative to each other at a multiple of the pitch with which the tubes are installed in the tube plate 3.

Figure 11:
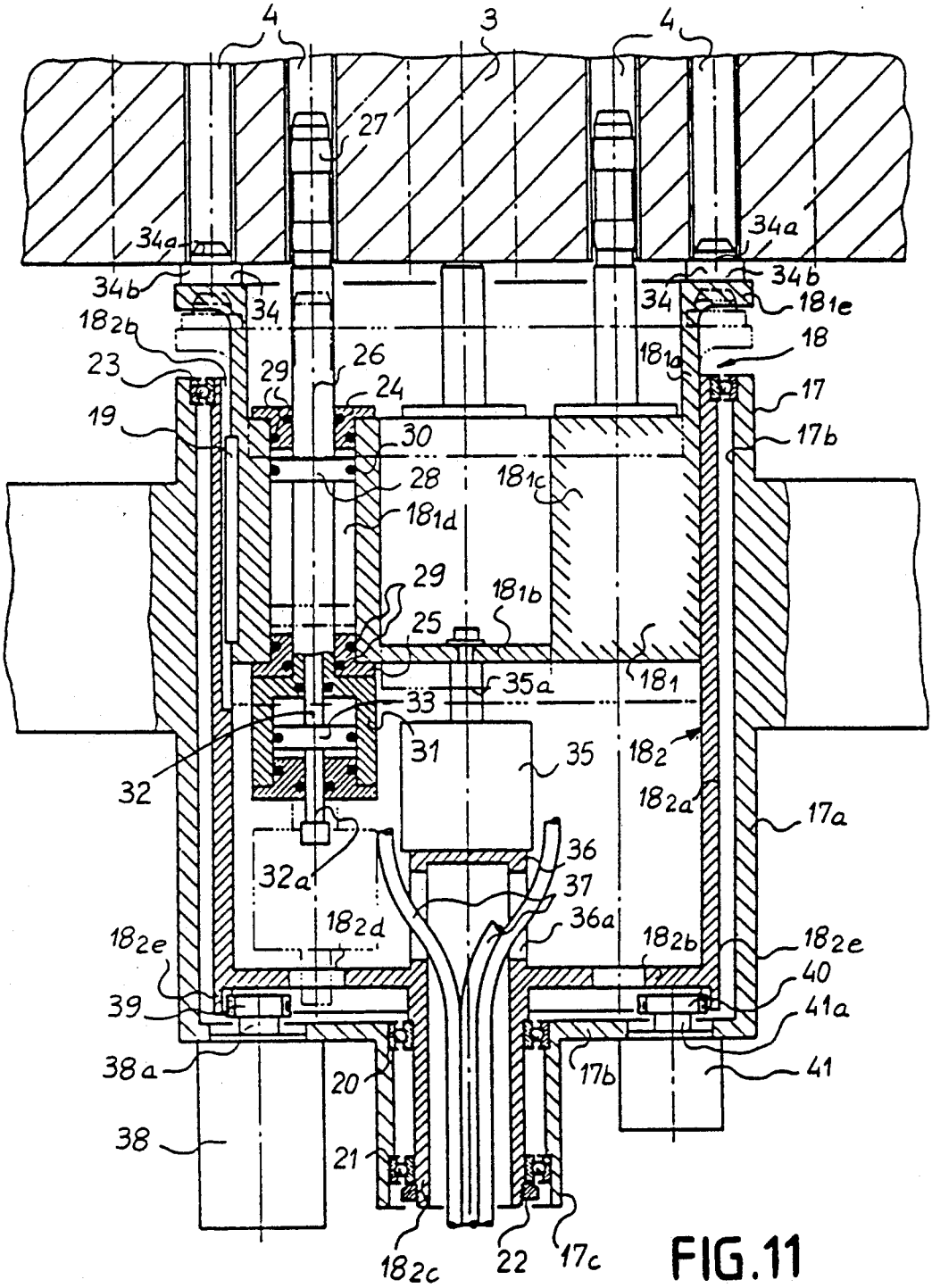
FIG. 11 is a diametral section view through a pivoting fastening head used in the vehicles of the preceding figures.

When the vehicle is in its working position beneath the plate 3, the moving element $18_1$ of the shaft 18 may be displaced towards the element $18_2$ in order to extract the studs 34 from the tubes 4, and this is shown in dot-dashed lines in FIG. 11. The moving element $18_1$ is displaced in translation relative to the element $18_2$ by means of a double-acting actuator 35, e.g. a pneumatically operated actuator. The actuator 35 is coaxial with the shaft 18 and is fixed to a support 36 extending inside the shaft 18 and fixed to the end wall $18_{2b}$ of the element $18_2$. The said support 36 is hollowed out and its side wall includes opening 36*a* through which hoses 37 are passed in order to feed the actuators 18, 31, and 35. The end wall $18_{2b}$ includes circular openings $18_{2d}$, e.g. four such openings and disposed at 90° intervals from one another so that each of them is coaxial with one of the fingers 27. These openings receive the guide rods 32*a* of the actuators 31 when the fingers are in the retracted position inside the shaft, as shown in dot-dashed lines in FIG. 11.

The shaft 18 is rotated relative to the cylindrical body 17 by means of a motor 38 fixed outside the end wall 17*b* of said body and having its shaft 38*a* extending into the body 17 with a gear wheel 39 being fixed to the end of the shaft.

The gear wheel 39 meshes with a toothed ring having inside teeth $18_{2e}$ fixed to the end wall $18_{2b}$ of the element $18_2$ of the telescopic shaft 18.

This ring $18_{2e}$ co-operates with another gear wheel 40 fixed on the shaft 41*a* of an absolute encoder 41 which is fixed to the cylindrical body 17 and which projects outside it.

The pivoting fastening head described above has four positioning fingers 27.

This number is not limiting and such a head merely requires at least two such fingers 27, but could have more depending on the layout of the tubes in the tube plate.

In the embodiment shown in FIGS. 5 and 6, the vehicle has two fastening heads identical to that described above. Thus, the arm 14 is fixed to the body 17 of end head 12 and to the body 17 of intermediate head 13. The arm 15 which carries the tool support 16 is telescopic and is fixed to the body 17 of the intermediate head 13, and extends above-mentioned arm 14. In a variant embodiment, the arm 14 is likewise telescopic, as shown in dashed lines in FIGS. 5 and 6.

It will be understood, that when the vehicle is fastened to the tube plate 3 by the fingers in the end head 12, it is capable of pivoting about the axis of the end head 12 (reference O), and under these conditions the tool carrier 16 describes a circular arc of radius R, while the intermediate head 13 describes a circular arc of radius $R_1$. Similarly, when the vehicle is fastened by means of the fingers in the intermediate head, it is capable of pivoting about the axis of said intermediate head (reference $O_1$) and the end head 12 describes a circular arc of radius $R_2$ while the tool carrier describes a circular arc of radius $R_3$.

Each of the heads 12 and 13 is caused to rotate under drive from its motor 38 which causes the shaft 18 to rotate relative to the body 17, with the angle through which said shaft rotates relative to said body being sensed by the absolute encoder 41 whose information is transmitted to the control desk 9, thereby enabling the vehicle to be remotely controlled in order to inspect tubes of the apparatus.

FIGS. 7 and 9 show two other embodiments of a vehicle of the invention in which the intermediate fastening head is articulated.

Figure 12:
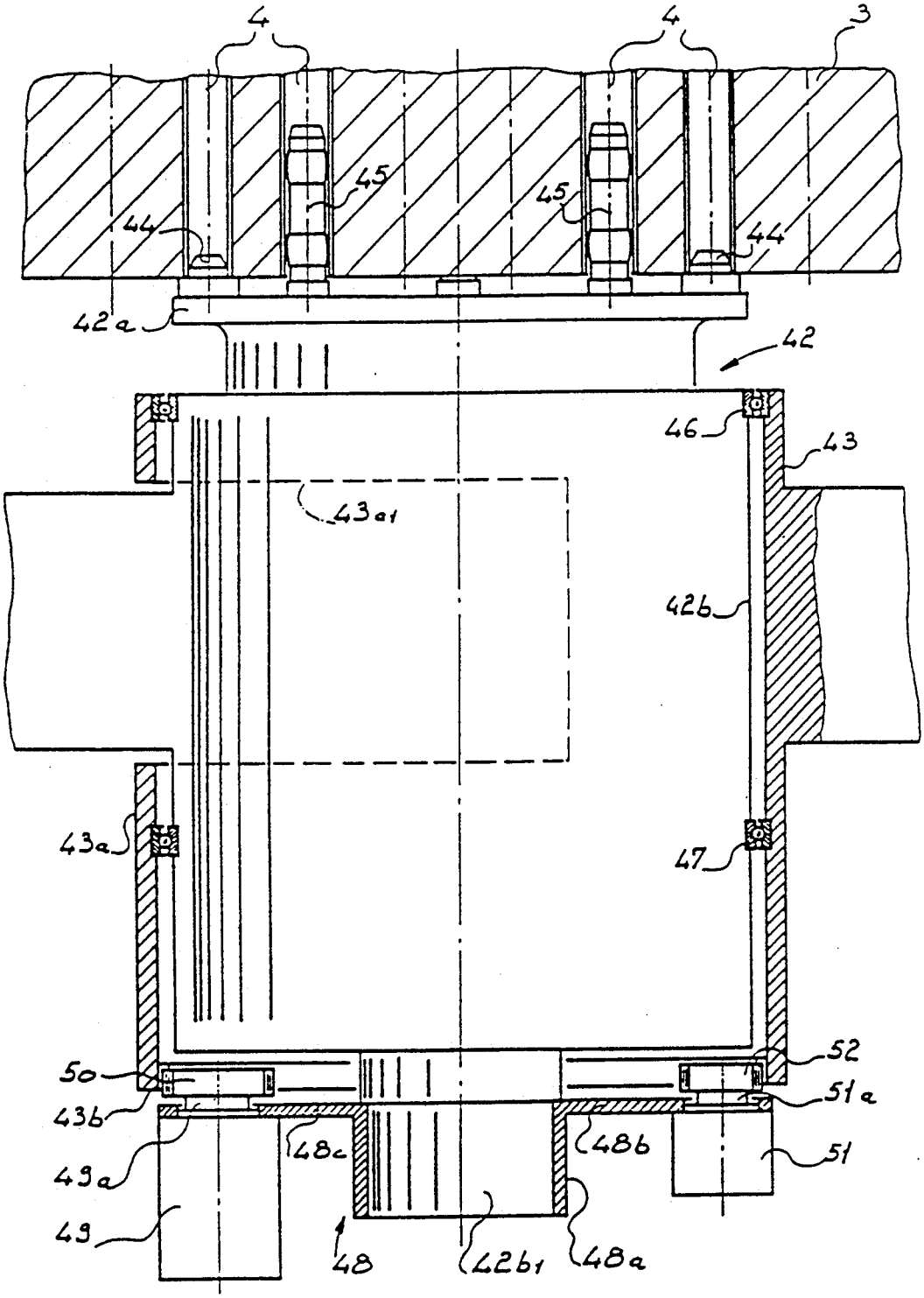
FIG. 12 is a diametral section view through the body of an intermediate pivoting fastening head fitted to the vehicles of FIGS. 7 to 10.

One such head is shown in FIG. 12 of the drawings, which head includes a telescopic shaft identical to that of the head in FIG. 11 except for the way in which it is mounted in the said cylindrical body and except for the means for rotating the shaft relative to said body.

In this embodiment, the side wall $43_a$ of the cylindrical body 43 includes a large rectangular opening $43_{a1}$ enabling the arms of the vehicle to rotate through an angle of about 210° relative to each other, for example. This opening is situated in the top half of the body 43 and is therefore on the same side as that through which the moving element 42*a* of the shaft emerges, which element includes centering studs 44 and positioning fingers 45 mounted in the same manner and operating in the same way as the studs 34 and the fingers 27 of the shaft 18 shown in FIG. 11.

The opening $43_{a1}$ is thus an elongate rectangular opening extending perpendicularly to the generator lines of the cylindrical body 43.

In this embodiment, the shaft 42 is mounted to rotate in the body 43 via its element 42*b* received in two ball bearings 46 and 47, one of which, 46, is situated at the top end of the body 43, and the other of which, 47, is situated in the bottom second half of said body.

At its end opposite from said moving element 42*a*, the telescopic shaft 42 includes a cylindrical collar $42_{b1}$ which is coaxial with the element 42*b* of said shaft, which collar may have a support 48 fixed thereon, e.g. by means of a force-fitted key (not shown), said support 48 comprising a body 48*a* having a bore in which the collar 42*b1* is engaged, and two diametrically opposite arms 48*b* and 48*c* extending on either side of the body 48*a* perpendicularly to the axis of revolution of the telescopic shaft 42. The end of the arm 48*c* carries the motor 49 which is fixed beneath the arm, having its shaft 49*a* carrying a gear wheel 50 which meshes with the internal teeth of a toothed ring 43*b* provided at the open bottom end of the cylindrical body 43 of the pivoting fastening head.

The end of the arm 48*b* carries an absolute encoder 51 fixed beneath the arm with its shaft 51*a* carrying a gear wheel 52 which meshes with the teeth of said ring 43*b*.

It will be understood that by switching on the motor 49, the body 43 is caused to rotate relative to the telescopic shaft 42, and that the angular displacement is sensed by the absolute encoder 51.

In the embodiment of the vehicle shown in FIG. 7, the end head 12 and the intermediate head 13 are interconnected by means of an arm 53 having one of its ends fixed to the cylindrical body 17 of the end head 12 as described with reference to FIG. 11, and having its other end fixed to the portion 42*b* of the telescopic shaft 42 described with reference to FIG. 12. The arm 53 moves through the rectangular opening $43_{a1}$ of the body 43 when the vehicle is caused to articulate. The vehicle includes another arm 54 which is telescopic and identical to the arm referenced 15 in FIG. 5, with its moving element 54*a* carrying a tool support 55.

The vehicle shown in FIG. 9 comprises the same units as the vehicle shown in FIG. 7 except for the arm inter-connecting the end head 12 and the intermediate head 13, which arm, 56, is telescopic. The moving element 56*a* of said arm passes through the rectangular opening $43_{a1}$ and is fixed to the element 42*b* of the shaft 42 mounted in the head 13.

FIGS. 8 and 10 show the amplitude of the angle through which the arm 54 can pivot relative to the arms 53 and 56, which amplitude is an angle of 210°, for example.

In order to enable the vehicle to be fastened to the tube plate of a steam generator, and in order to enable it to be inserted into the water tank 2 via the manhole 2*b*, the arm 14, 53, 56 interconnecting the heads 12 and 13 is articulated about an axis 57 extending perpendicularly to the axes of the heads 12 and 13. As shown in FIGS. 5, 7, and 9, said arm 14, 53, or 56 comprises a short portion 14*a*, 53*a*, 56*b*, fixed to the head 12 and a longer portion 14*b*, 53*b*, 56*c*, fixed to the head 13, with said portions 14*a* & 14*b*, 54*a* & 54*b*, or 56*b* & 56*c* being articulated to each other about said axis 57 which is closer to end head 12. Thus, when the vehicle is in its position for being inserted into the water tank 2 with the head 12 presented perpendicularly to the tube plate 3, the portion 14*b*, 53*b*, 56*c* of the arm 14, 53, or 56, and the arm 15 or 54 are locked in a position parallel to the axis of the head 12, whereas in the working position, said arms are locked perpendicularly to the axis of said head 12, with the arms extending parallel to the tube plate 3.

The means for articulating the arms 14, 53, or 56 are constituted, for example, by two double-acting pneumatic actuators $57_1$, one disposed on each side of the arm.

The actuators $57_1$ are hinged firstly to the portion 14*a*, 53*a*, or 56*b* of the arm and secondly to the other portion 14*b*, 53*b*, or 56*c*.

Figure 13:
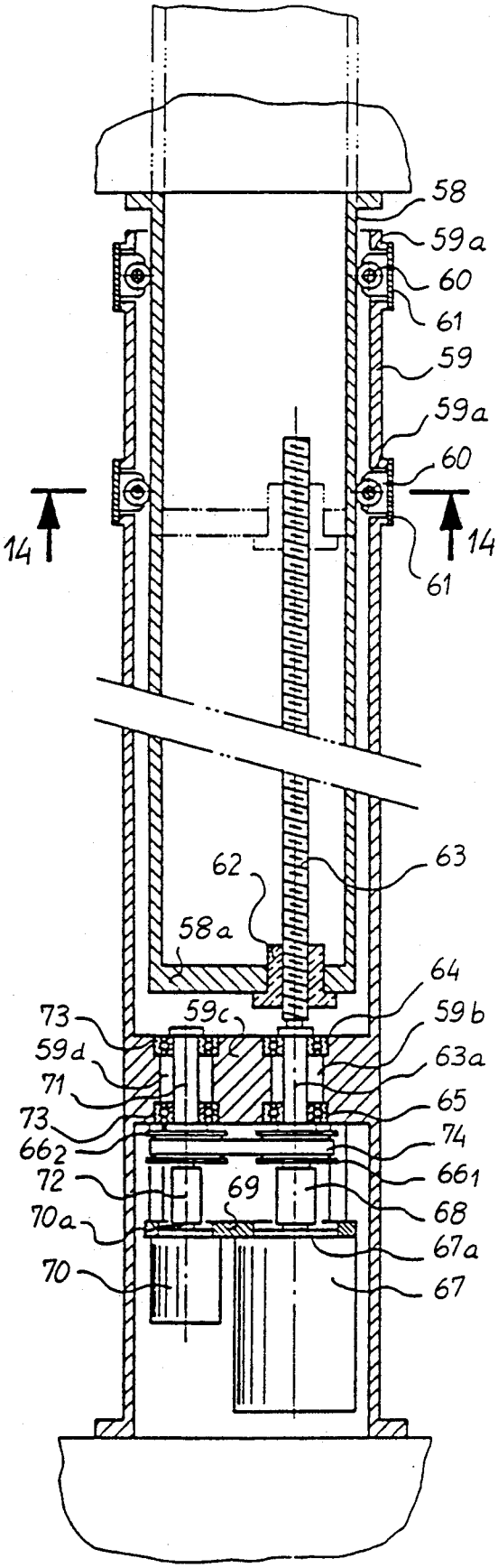
FIG. 13 is a longitudinal section view through a telescopic arm fitted to the vehicles of the preceding figures.
Figure 14:
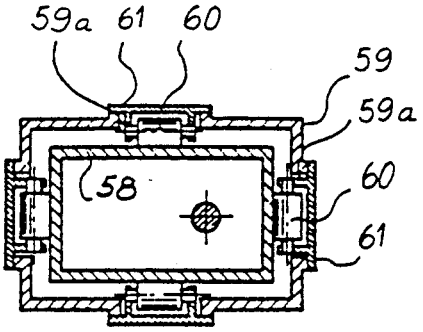
FIG. 14 is a section on line XIV—XIV of FIG. 13.

FIGS. 13 and 14 show a preferred embodiment of the telescopic arms used to constitute the vehicles shown in FIGS. 5, 7, and 9.

The moving tubular element 58 of such an arm is rectangular in right cross-section and it moves in longitudinal translation in the fixed tubular element while being guided by pairs of rolls 60 mounted to rotate freely on supports 61 passing through the walls of said fixed element via openings 59*a*, with the said support being fixed to said walls by any appropriate means. Each of the pairs of wheels is mounted on one of the walls of the fixed elements 59 and the wheels of each pair are spaced apart so as to ensure that the moving element 58 moves rectilinearly relative to the fixed element 59 under conditions of adequate accuracy.

As shown in FIG. 13, one of the wheels 60 in each of the pairs is situated at the free end of the fixed element.

The end of the moving element 58 situated inside the fixed element 59 includes a wall 58*a* perpendicular to the longitudinal axis of the element 58 and having a nut 62 mounted therein for co-operating with a backlash-free ball screw 63. This is mounted to rotate in a bearing 59*b* provided in a thick wall 59*c* extending perpendicularly to the longitudinal axis of the fixed portion 59 of the arm and situated at its end opposite to its free end having the openings 59*a* through which the guide rolls 60 pass.

The screw 63 includes a portion of smooth shank 63*a* mounted in two ball bearings 64 and 65 constituting the bearing 59*b*, and a pulley wheel $66_1$ is fixed to the end of said shank 63*a*. The screw 63 and its pulley wheel $66_1$ are situated on opposite sides of the wall 59*c* of said fixed element 59.

The screw 63 is connected to a motor 67, e.g. by means of a coupling sleeve 68 fixed to the shank 63*a* and to the shaft 67*a* of said motor, which is itself fixed on a support 69 fixed to the wall 59*c* of said fixed portion 59 of the arm.

The support 69 also includes an absolute encoder 70 disposed parallel with the motor 67 and having its shaft 70*a* connected to another shaft 71 via another coupling sleeve 72. The shaft 71 is mounted to rotate in another bearing 59*d* housed in said wall 59*c* of said fixed element 59 on two sets of ball bearings 73.

A pulley $66_2$ is fixed to the shaft 71 and is disposed adjacent to said pulley wheel $66_1$, with the two pulley wheels $66_1$ and $66_2$ being interconnected by a cog belt 74 so as to be constrained to rotate together.

Under drive from the motor 67, the screw 63 rotates and causes the moving element 58 of the arm to move in longitudinal translation. The encoder 70 connected to the motor and to the screw by the belt 74 and the pulleys $66_1$ and $66_2$ senses the position of the moving element 58 relative to the fixed element 59 of the arm at all times, which position is communicated to the control desk 9.

By pivoting the coupling heads 12 and 13 and/or extending and retracting the telescopic arms, it is possible to present one or other of the fastening heads or the tooling accurately relative to the tube =4 received in the tube plate 13.

FIGS. 15 and 16 show the end portion of the moving element of the telescopic arm 15, 54, with a two-position tool support 75 being mounted at the end thereof.

The said support comprises a body 75*a* having a tool carrier 75*b* pivotably mounted thereon to pivot about an axis parallel to the intermediate head 13, the tool carrier 75*b* being constituted by a rectangular plate extending parallel to the telescopic arm 15, 54. This plate has two male endpieces $75_{b1}$ which are disposed equidistant from its pivot axis and female end pieces 76*a* of the tool transferring hoses 76 are fixed to said male endpieces.

The tool carrier plate 75*b* is connected to a mechanism well known to the person skilled in the art for causing it to pivot through 180° so as to bring tools in turn level with a transfer duct $75a_1$ formed through the support 75 and extending parallel to the pivot axis of the plate 75*b*.

This mechanism may be constituted, for example, by a stepper electric motor integrated in the body 75*a* (not shown in the drawing).

Each end of the transfer duct 75*a* includes a coaxial chamber $75a_2$ or $75a_3$ having a tool-guiding sleeve 77 or 78 mounted therein. Each sleeve 77 or 78 has an annular piston 77*a*, 78*a* at its periphery, a thrust flange 77*b*, 78*b* at one of its ends and an inlet cone 77*c*, 78*c* at its other end.

The two sleeves 77 and 78 operate like double-acting actuators and each of them has two positions.

In one position, the sleeve 77 is at a distance from the tube plate 3 in order to allow the telescopic arm 15, 54 to pivot from the intermediate head 13, and simultaneously the sleeve 78 is at a distance from the tool carrier 75*b* in order to enable the tool carrier to pivot about its own axis.

In another position, the sleeve 77 has its flange 77*b* bearing against the said tube plate 3 in order to lie on the axis of one of the tubes 4, while simultaneously the sleeve 78 has its flange 78*b* bearing against the tool carrier so as to lie on the axis of a duct $75b_2$ coaxial with said male endpiece $75b_1$ for connection to the tool transfer hose 76.

It will be understood that the inside diameters of the tubes 4, the sleeves 77, 78, the ducts $75b_2$, and the hoses 76 are all identical. The chambers $75a_2$, $75a_3$ are closed by plugs 79 and are sealed by means of O-rings 80. The sealing between the pistons 77*a*, 78*a* and the chambers $75a_2$, and between the sleeves 77 and the communication duct $75a_1$ is provided by other O-rings 81.

On each half turn of the tool carrier 75*b*, a tool may be transferred and inserted in a tube 4 received in the tube plate 3.

Figure 2:
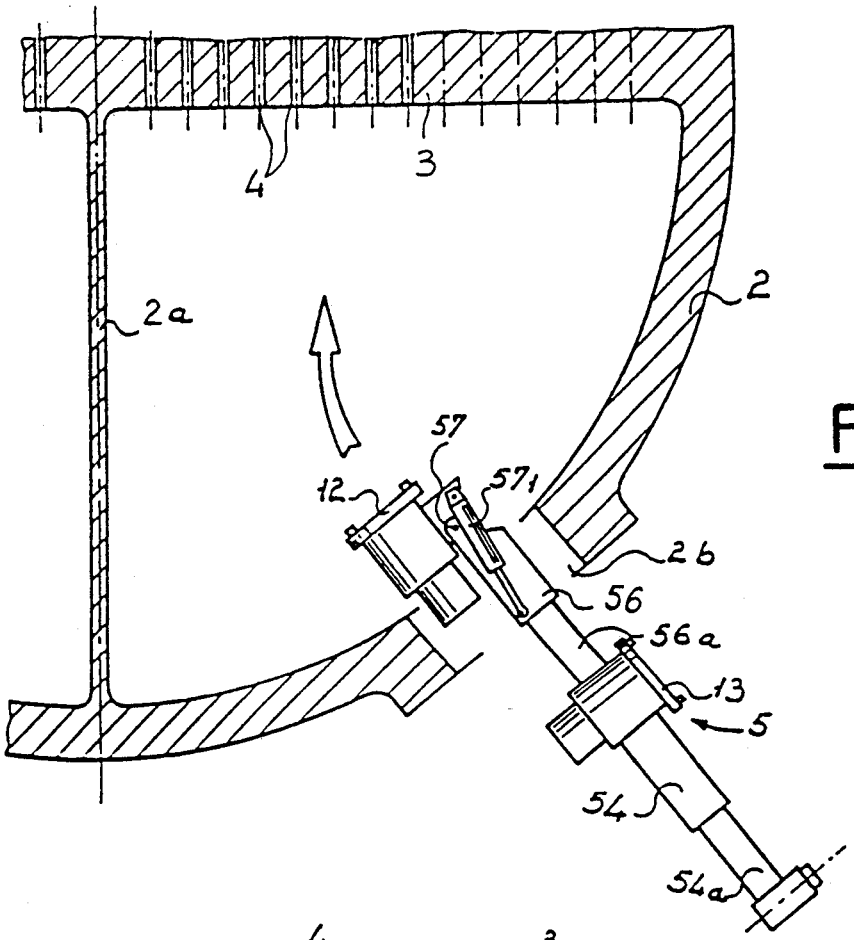
FIGS. 2 to 4 show various stages during the insertion and the fastening of said vehicle in the water tank of said generator.
Figure 3:
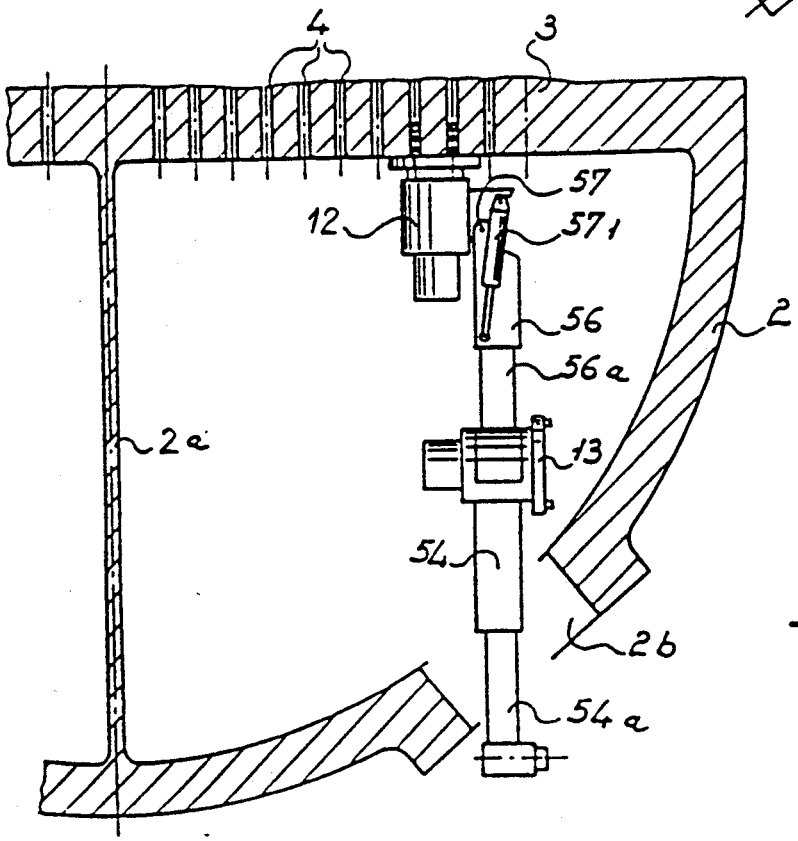
Figure 4:
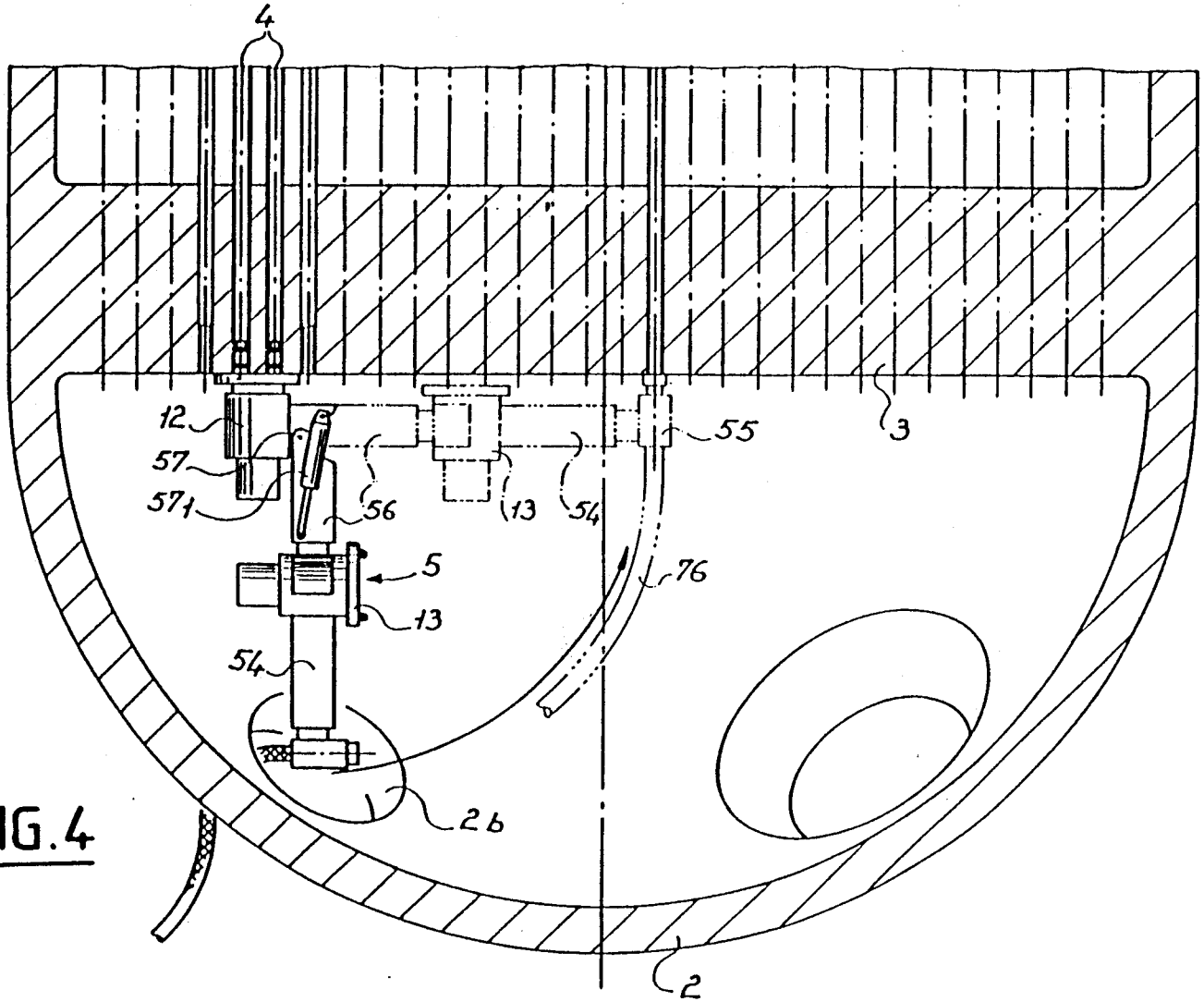

Installation of a vehicle of the invention in the water tank 2 of a steam generator or the like is illustrated in FIGS. 2 to 4 of the drawings.

Prior to being inserted, the vehicle (e.g. the embodiment shown in FIG. 9) is folded about the axis 57 by the actuators $57_1$ in order to cause its end head 12 to occupy a position parallel to the arms 54, 56 and perpendicular to the intermediate head 13. The telescopic arms 54 and 56 are fully extended.

The vehicle 5 is inserted into the water tank 2 while in this position, as shown in FIG. 2, with the end head 12 being inserted first via the manhole 2*b*.

Thereafter, the head 12 is put into contact with the tube plate 3 (FIG. 3) and said head is positioned by inserting the centering studs 34 into holes through the plate, thereby bringing the positioning fingers 27 into alignment with the axes of respective tubes 4.

The fingers 27 are then inserted into the tubes and expanded in order to fasten the vehicle 5 to the plate 3.

Thereafter, the arms 54 and 56 are caused to retract to minimum length in order to bring the vehicle into the water tank 2, after which the head 12 is rotated so as to bring the vehicle into a position which is suitable for it to be raised. The actuators $57_1$ are then operated to pivot the assembly constituted by the arm 56, the head 13, and the arm 54 about the axis 57, thereby bringing the vehicle into a position where it is substantially parallel to the plate 3, after which the position of the vehicle 5 relative to the plate 3 is observed in order to be able to move the vehicle and position the tool carrier so as to observe tubes requiring action, be that mere inspection or some other operation such as plugging the tube or reconditioning it.

Access is obtained to the tubes 4 by causing one or both of the servo-controlled heads 12 and 13 to rotate and/or by extending or retracting one or both of the telescopic arms 15, 54, 56.

For any position in which one or other of the heads 12 or 13 is fastened to the tube plate, there corresponds an annular zone covering a portion of the holes leading to the bundle of tubes into which a tool may be inserted. The characteristics of this zone depend on the minimum and maximum radiuses of action extending from the center of one or other of the fastening heads to the axis of the transfer duct in the tool carrier.

All of the tubes 4 in the bundle of tubes engaged in the plate 3 are therefore accessible by displacing one or other of the rotating fastening heads 12 and 13. Unlike similar prior art apparatuses, displacements can be performed quickly with the apparatus of the invention using steps of arbitrary size by alternatively fixing one or other of the heads 12 and 13 and then causing the heads to pivot and optionally extending or retracting the associated arms.

The version of the FIG. 5 vehicle shown in which both of the arms 14 and 15 are telescopic operates as follows.

The end fastening head 12 (FIG. 22) is used on its own for scanning the plate 3 in association with the telescopic arms 14 and 15. When the arms are retracted, the tool carrier 16 describes a circular arc of radius $R_4$, and when the arms are extended it describes a circular arc of radius $R_5$.

These circular arcs delimit a working zone $Z_1$ within which all of the tubes 4 contained therein can be inspected.

The intermediate fastening head 13 is used for taking over fastening during rapid displacement by inserting its positioning fingers into tubes which are not adjacent to those in which the fingers on the head 12 are already inserted.

Fastening can be taken over arbitrarily: the vehicle may be rotated about the head 12 to position the head 13 so as to insert its fingers into the tubes, and/or the vehicle may be moved in translation along "line" or "column" directions, as shown in FIG. 21.

In the version of the FIG. 5 vehicle where the arm 14 is not telescopic, the principle remains the same as above except that the inspection zone $Z_2$ as delimited by circular arcs $R_6$ and $R_7$ is narrower.

Construction of the vehicle is simplified since it only has one telescopic arm 15, however the definition of the inspection zones is constrained as a function of the fastening positions of the heads 12 and 13 given that they are at a fixed distance apart.

An example of the displacement of a vehicle of this design is described with reference to FIG. 17, where the vehicle is displaced by successive rotations of the end head 12 and the intermediate head 13, e.g. rotations through 90°.

Whenever one or other of the heads of the vehicle is fastened to the tube plate, the vehicle may be rotated through 0° to 360°, and given that the arm 15 is capable of being extended, this nevertheless makes it possible to reach a large number of tubes.

FIGS. 23 and 24 show examples of how the vehicle shown in FIGS. 9 and 10 can be used.

In this embodiment, the intermediate fastening head 13 is used on its own for inspecting the plate. It is therefore under programmed servo control. The end head 12 is used for taking over fastening to perform rapid displacements in order to cover the distances between one annular inspection zone and another, and also for inspecting the tubes in one of these zones. Since both heads 12 and 13 are fastened to the tube plate 3 while tubes are being inspected, the mechanical fixing of the vehicle is improved, thereby facilitating certain operations which require tooling to be used with force.

Since the arm 54 is articulated to the intermediate head 13 (FIG. 24), it can cover an angle of 210°, for example, and since it is also capable of extending, its inspection zone $Z_3$ is delimited by two circular arcs of radius $R_8$ and $R_9$.

FIG. 23 shows displacement of the vehicle in linear translation in "lines" or in "columns" as it moves from one zone to another.

Figure 19:
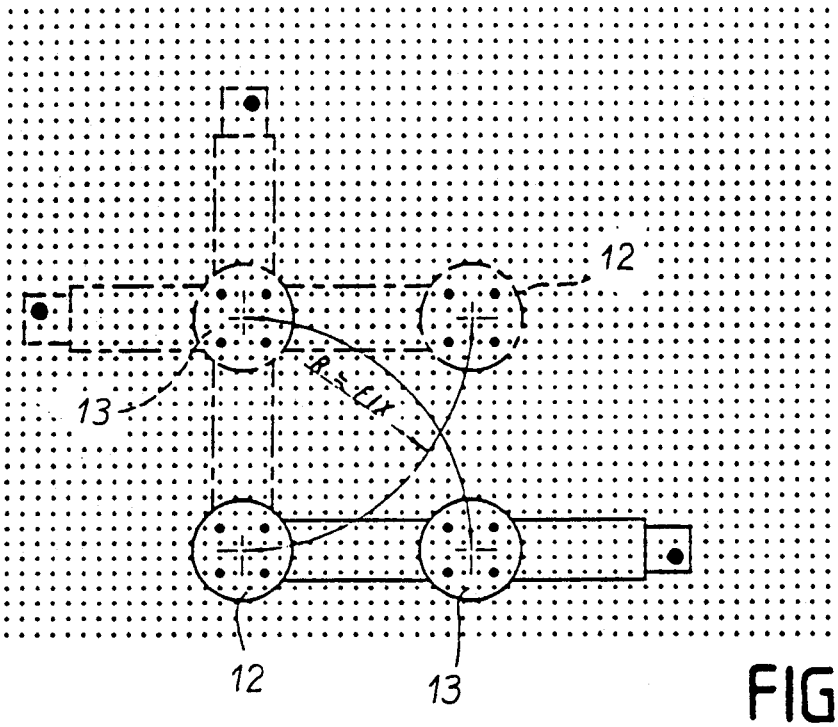
Figure 20:
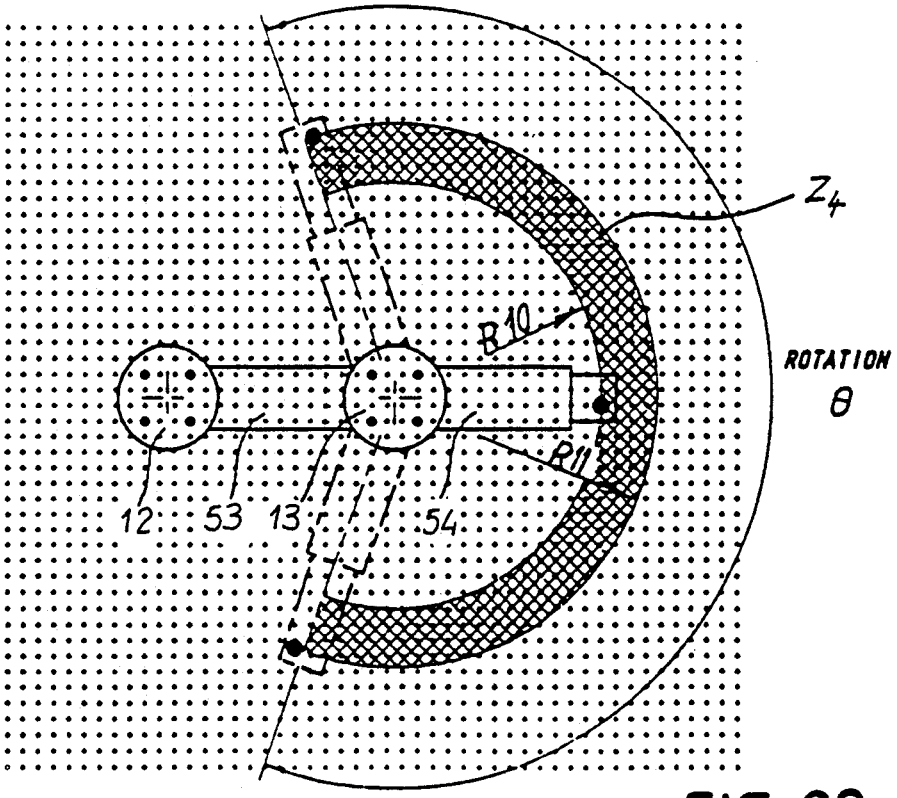

FIGS. 19 and 20 show examples of displacement of a vehicle as shown in FIGS. 7 and 8. The servo-controlled drive used for inspection purposes is mounted in the intermediate fastening head 13.

The distance between the two heads 12 and 13 is fixed, and the articulated arm 54 is telescopic. As in the preceding example, the head 13 is used during plate inspection. The arm 54 can cover an angle of 210°, and given that it is also capable of elongation, its zone $Z_4$ identical to the zone $Z_3$ of the preceding example is delimited by circular arcs $R_{10}$ and $R_{11}$.

FIG. 19 shows an example of displacement of the vehicle over the tube plate 3, and this figure illustrates in general manner the various stages in the displacement of the FIG. 5 vehicle as shown in FIG. 17. Like the FIG. 5 vehicle, the two fastening heads 12 and 13 of the FIG. 7 vehicle are a fixed distance apart, which means that the inspection zone is constrained as a function of the fastening positions of the heads 12 and 13.

What is claimed is:

1. A vehicle for selectively positioning a tool relative to tubes in a bundle of tubes received in a tube plate and opening out into an enclosure including an access opening, the vehicle comprising at least two transfer arms including means for causing expansible positioning fingers to penetrate into said tubes and for extracting said fingers from said tubes perpendicularly to said tube plate in order to displace the vehicle adjacent the face of the tube plate situated in said enclosure, with at least one of said arms including a tool support having means for presenting a tool successively on the axis of a plurality of tubes in the plate, which vehicle includes at least two pivoting fastening heads, an extremity head and an intermediate head, each of said heads comprising a body with a cylindrical bore in which a hollow telescopic shaft is coaxially mounted, said shaft comprising two elements, one of which is moveable in translation by drive means, and the other of which is mounted to rotate in said body, said expansible positioning fingers being mounted in said moving element by means capable of extending said expansible positioning fingers beyond the end of said shaft or of retracting said fingers into said shaft, said fingers being parallel to each other and to said pivoting heads, said heads being fixed to said transfer arms, a first telescopic arm extending perpendicularly to said pivoting fastening heads which are interconnected to each other by the said first arm, and a second telescopic arm fixed to said intermediate head and extending perpendicularly to said intermediate head and supporting said tool support.

2. A vehicle according to claim 1, in which the two elements of the telescopic shaft are interconnected to each other by a sliding key in order to be constrained to rotate together.

3. A vehicle according to claim 2, in which each pivoting fastening head includes at least two positioning fingers.

4. A vehicle according to claim 3, in which each fastening head includes four positioning fingers disposed in a square and diametrically opposite to each other in pairs along two perpendicular axes.

5. A vehicle according to claim 4, in which the moving element has a plane annular zone extending perpendicularly to the axis of revolution of the shaft and located at the end of the said moving element which is situated outside the said other element of the telescopic shaft, said plane annular zone having at least two centering studs extending therefrom and situated outside said positioning fingers, said studs being slightly smaller in diameter than the holes through the tube plate and having conical tips in order to facilitate insertion thereof into said holes.

6. A vehicle according to claim 5, in which said arms are fixed to the bodies of said pivoting heads, and each head includes means for causing the body and the telescopic shaft to pivot relative to each other, together with means for sensing their relative angular displacement.

7. A vehicle according to claim 6, in which the element of the shaft which is rotatably mounted in the body of each pivoting head has a toothed ring at its end situated facing the end wall of the body, with the relative pivoting of the body and the telescopic shaft being obtained by means of a motor fixed to said body and having a gear wheel fixed to its drive shaft and meshing with the said toothed ring, and with the relative angular displacement of the body and the shaft being sensed by an absolute encoder fixed to said body and including a gear wheel meshing with said toothed ring.

8. A vehicle according to claim 5, in which the body of one of the pivoting heads includes, in its side wall, an elongate opening extending perpendicularly to the generator lines of the body in order to enable one of the transfer arms to move angularly, which arm is fixed at its end, firstly to the element of the telescopic shafts which is mounted to rotate in said body, and secondly to the body of the other pivoting head, with the other arm to which the tool support is fixed being itself fixed to the body of the said one of the pivoting heads.

9. A vehicle according to claim 8, wherein the telescopic shaft has a coaxially mounted collar at its end opposite to its moving element, said collar being fixed to a support extending perpendicularly to said collar and said support having a motor fixed thereon, with the shaft of said motor having a gear wheel fixed thereon and meshing with a toothed ring situated at the open bottom end of the body of the pivoting head which includes said opening, thereby causing said body to pivot relative to said telescopic shaft, said support also having an absolute encoder fixed thereon including a gear wheel which meshes with said ring in order to sense the relative angular displacement of said body and said telescopic shaft.

10. A vehicle according to claim 9, in which each telescopic arm comprises a moving element guided in a fixed element, with said moving element being moved in translation by a motor mounted in the fixed element of the arm and rotating a backlash-free ball screw which co-operates with a nut fixed at the end of the moving element situated inside the said fixed element, said motor being coupled to an absolute encoder which, at all times, specifies the relative position between the fixed element and the moving element of said arm.

11. A vehicle according to claim 10, in which the arm interconnecting said pivoting heads is articulated about an axis perpendicular to the axes of said heads and situated adjacent to said end head, the vehicle including means for causing the arm to pivot and for locking it in position, either in a working position where it extends perpendicularly to the heads, or else in a position for insertion into the enclosure and for fastening to the tube plate, in which position said arm extends parallel to the end pivoting head.

12. A vehicle according to claim 11, in which the tool support has at least two positions for presenting at least two tools in succession to the same tube in the tube plate, the tool carrier being disposed parallel to said tool-carrying telescopic arm in a position perpendicular to the pivoting heads so as to present each tool in turn to a transfer duct provided through the end of the moving element of said arm, which duct includes means for guiding the tool and for transferring it from the support to said tube in the tube plate.

13. A vehicle according to claim 12, in which each end of said transfer ducts includes a respective coaxial chamber communicating with the other chamber with each of said chambers receiving a tool-guiding sleeve mounted as a piston, said sleeves operating simultaneously in the tool transfer position firstly to provide a connection between the arm and the tube plate, with one of the sleeves engaging one of the tubes coaxially, and secondly to provide a connection between the arm and said support, with the other sleeve coaxially engaging the orifice of said tool support.

* * * * *